US007673620B2

(12) United States Patent
Maehara et al.

(10) Patent No.: US 7,673,620 B2
(45) Date of Patent: Mar. 9, 2010

(54) INTERNAL COMBUSTION ENGINE WITH BREATHER CHAMBER

(75) Inventors: Hayato Maehara, Saitama (JP); Taku Hirayama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/210,805

(22) Filed: Sep. 15, 2008

(65) Prior Publication Data

US 2009/0071421 A1 Mar. 19, 2009

(30) Foreign Application Priority Data

Sep. 18, 2007 (JP) ..... 2007-240437

(51) Int. Cl.
*F02F 7/00* (2006.01)
*F01M 13/00* (2006.01)
*F01L 13/00* (2006.01)

(52) U.S. Cl. ..... 123/572; 123/198 F

(58) Field of Classification Search ..... 123/572–574, 123/41.86, 198 F, 198 DC
See application file for complete search history.

(56) References Cited

U.S. PATENT DOCUMENTS 4,366,788 A * 1/1983 Tanaka et al. ..... 123/198 F
4,493,295 A * 1/1985 Ampferer ..... 123/41.86
4,721,090 A * 1/1988 Kato ..... 123/572
6,412,478 B1 * 7/2002 Ruehlow et al. ..... 123/572
2007/0281205 A1 * 12/2007 Wagner et al. ..... 429/49
2008/0236520 A1 * 10/2008 Maehara et al. ..... 123/52.1

FOREIGN PATENT DOCUMENTS

JP 2006-283578 A 10/2006

* cited by examiner

*Primary Examiner*—Marguerite J. McMahon
(74) *Attorney, Agent, or Firm*—Birch, Stewart, Kolasch & Birch, LLP

(57) ABSTRACT

A cylinder head cover, on which a breather chamber wall and control valve device are mounted is not enlarged while the capacity of a breather chamber is increased. For an internal combustion engine, control valve devices, which control the operation of a hydraulic valve stop mechanism that serves as a cylinder stop mechanism, and an outer chamber wall of a breather chamber wall that forms a breather chamber into which a blow-by gas flows, project in a predetermined direction and are mounted on the outer surface of a top wall of a cylinder head cover. When viewed in the predetermined direction, the outer chamber wall has an overlap section that overlaps with a part of the control valve device. Therefore, the overlap section is covered in the particular direction by the control valve device.

18 Claims, 5 Drawing Sheets

FIG. 3(b)
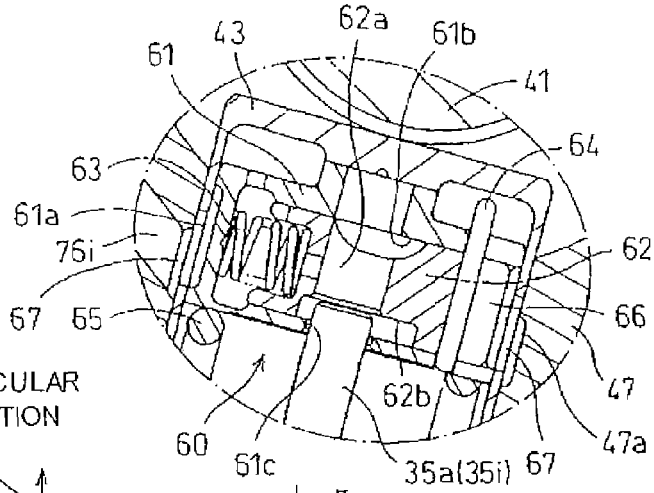
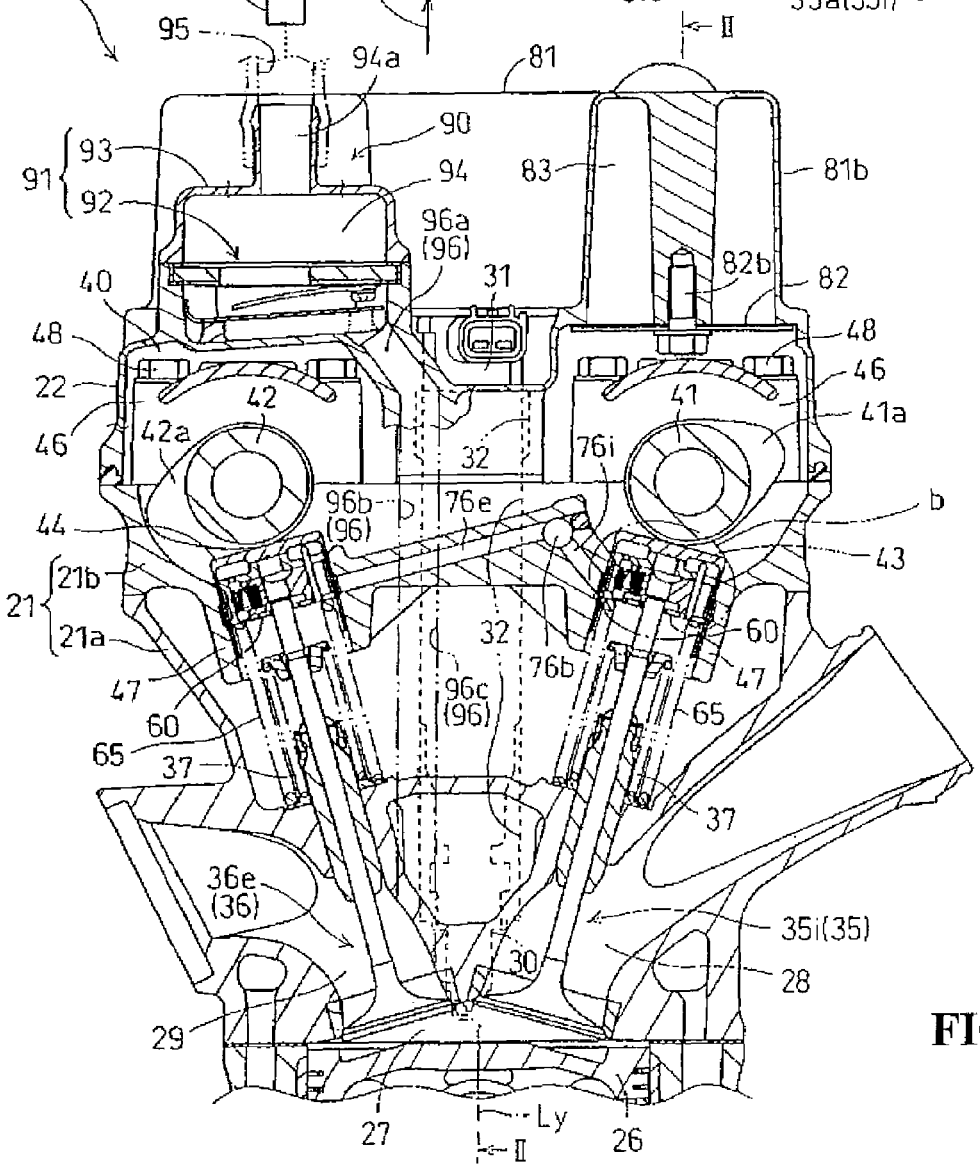
FIG. 3(a)

INTERNAL COMBUSTION ENGINE WITH BREATHER CHAMBER

CROSS-REFERENCE TO RELATED APPLICATIONS

The present application claims priority under 35 USC 119 to Japanese Patent Application No. 2007-240437 filed on Sep. 18, 2007 the entire contents of which are hereby incorporated by reference.

BACKGROUND OF THE INVENTION

1. Field of the Invention

The present invention relates to an internal combustion engine with a breather chamber for a breather that provides a flow of blow-by gas backward to an intake path.

2. Description of Background Art

An internal combustion engine is disclosed in JP-A No. 2006-283578 wherein an operation control unit (e.g., hydraulic control valve device) for controlling the operation of an operation control mechanism (e.g., hydraulic cylinder stop mechanism), which controls an engine operating state, and a breather chamber wall for forming a breather chamber are positioned so as to protrude from the outer surface of a cylinder head cover that constitutes an engine main body.

Not only the breather chamber wall, which forms a breather chamber, and the hydraulic control valve device but also a secondary air supply device 90 for an exhaust system, an ignition coil 31 integral with a spark plug 30, an engine status sensor, and other components are positioned on the outer surface of the cylinder head cover, which constitutes the engine main body together with a cylinder block and cylinder head. Therefore, these components need to be compactly arranged within a limited space.

Meanwhile, the breather chamber is capable of separating oil that is mixed with a blow-by gas. To enhance the oil separation efficiency, it is preferred to increase the capacity of the breather chamber. However, the space above the cylinder head cover is limited while various components are positioned on the cylinder head cover as described above. Therefore, it is difficult to increase the capacity of the breather chamber due to the limitations imposed by the other components. If an attempt is made to avoid interference with the other components and increase the capacity of the breather chamber, it is necessary to enlarge the cylinder head cover or the breather chamber wall protrudes out of the cylinder head cover, making it difficult to compactly set the cylinder head cover.

In addition, internal combustion engine parts (air cleaner, etc.) and parts for devices other than the internal combustion engine may be positioned above the cylinder head cover. Therefore, the upward protrusion of the breather chamber is limited.

SUMMARY AND OBJECTS OF THE INVENTION

The present invention has been made in view of the above circumstances. An object of the an embodiment of the present invention is to avoid the enlargement of an engine main body, which is provided with a breather chamber wall and an operation control unit, while increasing the capacity of the breather chamber.

In addition, an object of an embodiment of the present invention is to orient an overlap section of the breather chamber in a particular direction and position it compactly.

Further it is an object of an embodiment of the present invention to further increase the capacity of the breather chamber by enhancing the utilization of a space formed around the operation control unit.

An object of an embodiment of the present invention is to compactly position the operation control unit, which controls a cylinder stop mechanism, and a breather chamber wall while increasing the capacity of the breather chamber.

An object of an embodiment of the present invention is to compactly position an air cleaner and a cylinder head cover, which is provided with the breather chamber having an increased capacity.

According to an embodiment of the present invention, an internal combustion engine is provided that includes an operation control unit for controlling the operation of an operation control mechanism, which controls an engine operating state and a breather chamber wall for forming a breather chamber into which a blow-by gas flows. The operation control unit and the breather chamber wall protrude in a particular direction and are positioned on the outer surface of an engine main body. The breather chamber wall includes an overlap section that overlaps with a part of the operation control unit when viewed in the particular direction.

According to an embodiment of the present invention, the overlap section is covered in the particular direction by the operation control unit.

According to an embodiment of the present invention, the breather chamber wall has a concaved section that is shaped along the outline of the operation control unit, and wherein the overlap section is the concaved section.

According to an embodiment of the present invention, the engine main body has a plurality of cylinders and the operation control mechanism is a cylinder stop mechanism for stopping some of the plurality of cylinders.

According to an embodiment of the present invention, an air cleaner is provided wherein the outer surface is an outer surface of a top wall of a cylinder head cover that constitutes the engine main body and wherein the operation control unit and the breather chamber wall are positioned in a space formed between the air cleaner and the cylinder head cover.

According to an embodiment of the present invention, the breather chamber wall has an overlap section that overlaps with the operation control unit. Thus, the capacity of the breather chamber is increased by the overlap section. Further, the breather chamber wall and operation control unit are compactly arranged to prevent the enlargement of the engine main body that is equipped with the breather chamber wall and operation control unit.

According to an embodiment of the present invention, the overlap section of the breather chamber wall is positioned opposite the particular direction relative to the operation control unit and within the space formed between the operation control unit and the outer surface. Therefore, the overlap section is compactly positioned in the particular direction as compared to a case where the overlap section is positioned toward the particular direction relative to the operation control unit.

According to an embodiment of the present invention, the overlap section of the breather chamber is a concaved section that is formed along the outline of the operation control unit. This makes it possible to enhance the utilization of the space formed around the operation control unit. As a result, the capacity of the breather chamber can be further increased while compactly arranging the breather chamber wall and operation control unit.

According to an embodiment of the present invention, the breather chamber wall and the operation control unit for controlling the cylinder stop mechanism, which changes the number of operating cylinders, can be compactly arranged in a multicylinder internal combustion engine, which varies the number of cylinders, while increasing the capacity of the breather chamber.

According to an embodiment of the present invention, the breather chamber wall has an overlap section. Therefore, the breather chamber wall and operation control unit can be compactly positioned on the cylinder head cover. This makes it possible to prevent the enlargement of the cylinder head cover. As a result, the air cleaner and the cylinder head cover, which is provided with the breather chamber having an increased capacity, can be positioned close to each other for a compact arrangement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(*a*) is an essential part cross-sectional view of a cylinder head and cylinder head cover that is substantially taken along line III-III of FIG. 4;

FIG. 3(*b*) is an enlarged view of section b in FIG. 3(*a*);

DETAILED DESCRIPTION OF THE PREFERRED EMBODIMENTS

An embodiment of the present invention will now be described with reference to FIGS. 1 to 5.

Figure 1:
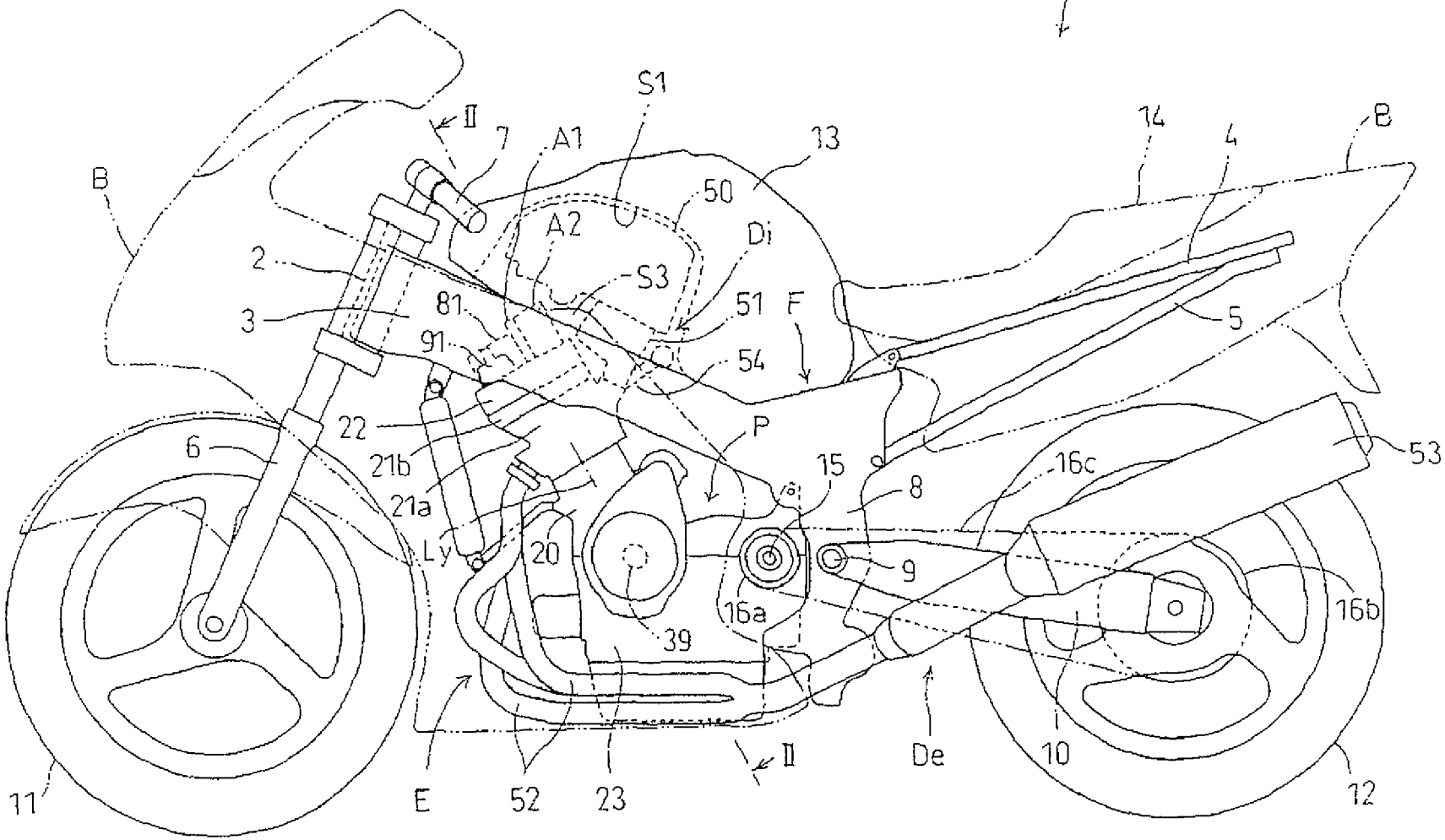
FIG. 1 is a left side view that schematically shows a motorcycle in which an internal combustion engine according to the present invention is mounted.

Referring to FIG. 1, an internal combustion engine E according to the present invention is a water-cooled, four-stroke internal combustion engine that is transversely mounted in a motorcycle 1, which is used as a vehicle. A crankshaft 39 of the internal combustion engine E is oriented in the vehicle width direction. The internal combustion engine E and a transmission (not shown) having an input shaft coupled to the crankshaft 39 constitute a power unit P.

In the present embodiment, references to direction (up, down, front, rear, left, and right) are made relative to the motorcycle 1 unless otherwise stated.

The motorcycle 1 includes a vehicle body and a power unit P. The vehicle body includes a vehicle body frame F and a vehicle body cover B, which covers the vehicle body frame F. The power unit P is supported by the vehicle body frame F. The vehicle body frame F includes a head pipe 2, a pair of right and left main frames 3, which extend rearward from the head pipe 2 and support a fuel tank 13, a pair of right and left seat rails 4, which connect to the rear of the main frames 3, extend rearward, and support a seat 14 and a pair of right and left rear frames 5, which couple the rear of the main frames 3 to the rear of the seat rails 4.

A front fork 6 is steerably supported by the head pipe 2. A front wheel 11 is journaled to the lower end of the front fork 6. A handlebar 7 is mounted on the upper end of the front fork 6. The front end of a pair of right and left swing arms 10 is swingably supported by a pivot shaft 9, which is provided on a pair of right and left pivot plates 8 that extend downward from the rear of each main frame 3. A rear wheel 12 is journaled to the rear end of the swing arms 10.

An output shaft 15 for the transmission is positioned on the rear of the power unit P, which is supported by the main frames 3. Motive power generated by the internal combustion engine E is input into the transmission via the crankshaft 39, subjected to a gear change in the transmission, and transmitted from the output shaft 15 to the rear wheel 12 via a final reduction gear mechanism. The final reduction gear mechanism includes a drive sprocket 16*a*, which is fastened to the output shaft 15, a driven sprocket 16*b*, which is fastened to the rear wheel 12 and an endless chain 16*c*, which is threaded over the sprockets 16*a*, 16*b*.

Figure 2:
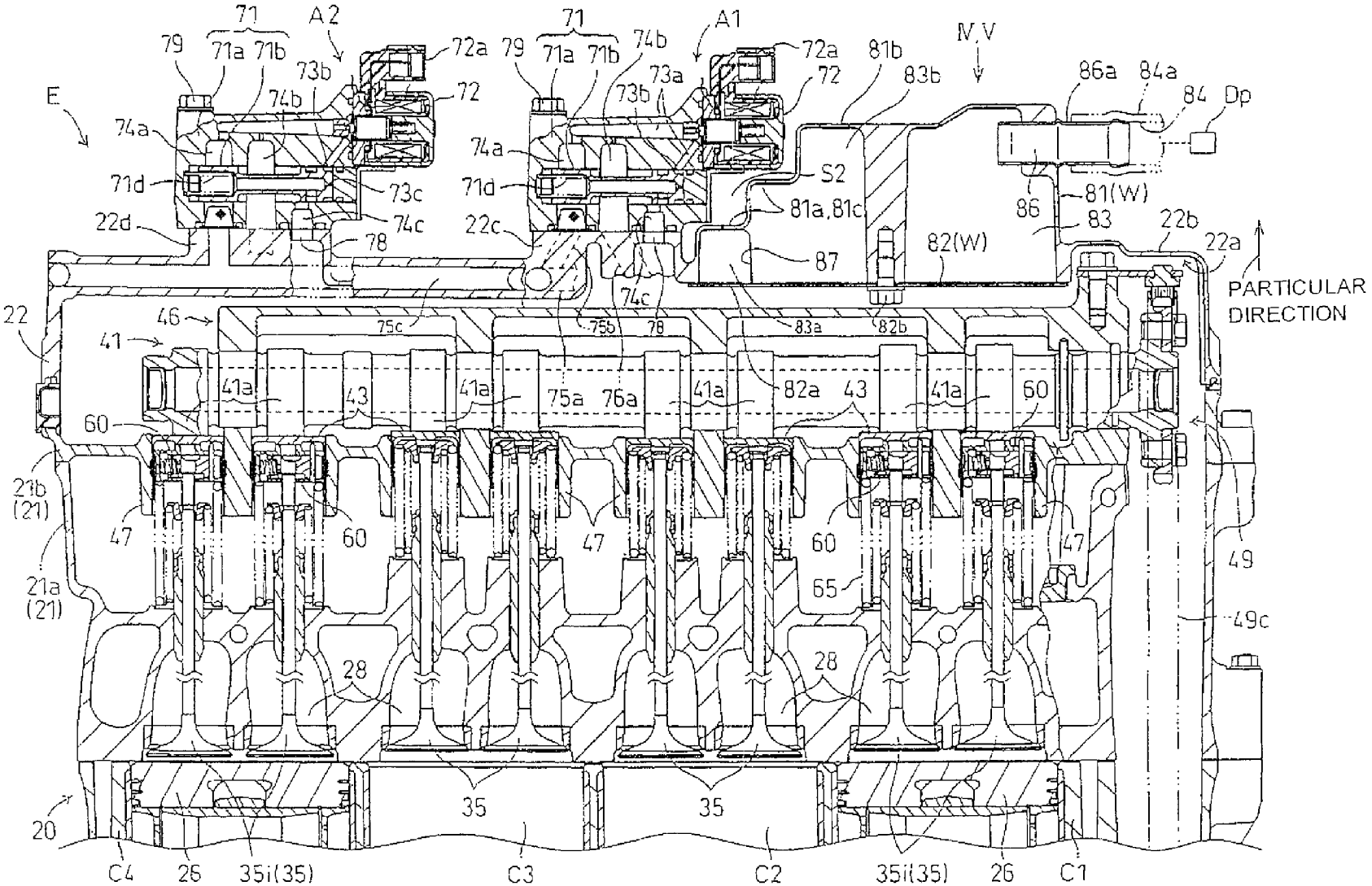
FIG. 2 is an essential part cross-sectional view that is substantially taken along line II-II of FIGS. 1 and 3(*a*)

Referring also to FIGS. 2 and 3, the internal combustion engine E includes one cylinder or a predetermined plurality of cylinders. Here, it is assumed that the internal combustion engine E is a multicylinder, four-stroke internal combustion engine in which four cylinders C1-C4 are serially arranged.

The internal combustion engine E includes an engine main body. The engine main body includes a cylinder block 20 having four cylinders C1-C4 to which pistons 26 can reciprocatingly be fitted, a cylinder head 21, which is coupled to the upper end face of the cylinder block 20, a cylinder head cover 22, which is coupled to the upper end face of the cylinder head 21 and a crankcase 23, which is coupled to the lower end of the cylinder block 20.

Each cylinder C1-C4 has a cylinder axis Ly that is slanted slightly forward relative to a vertical line. The cylinder block 20, which doubles as a transmission case for housing the transmission, and the crankcase 23 form a crank chamber that houses the crankshaft 39.

Figure 4:
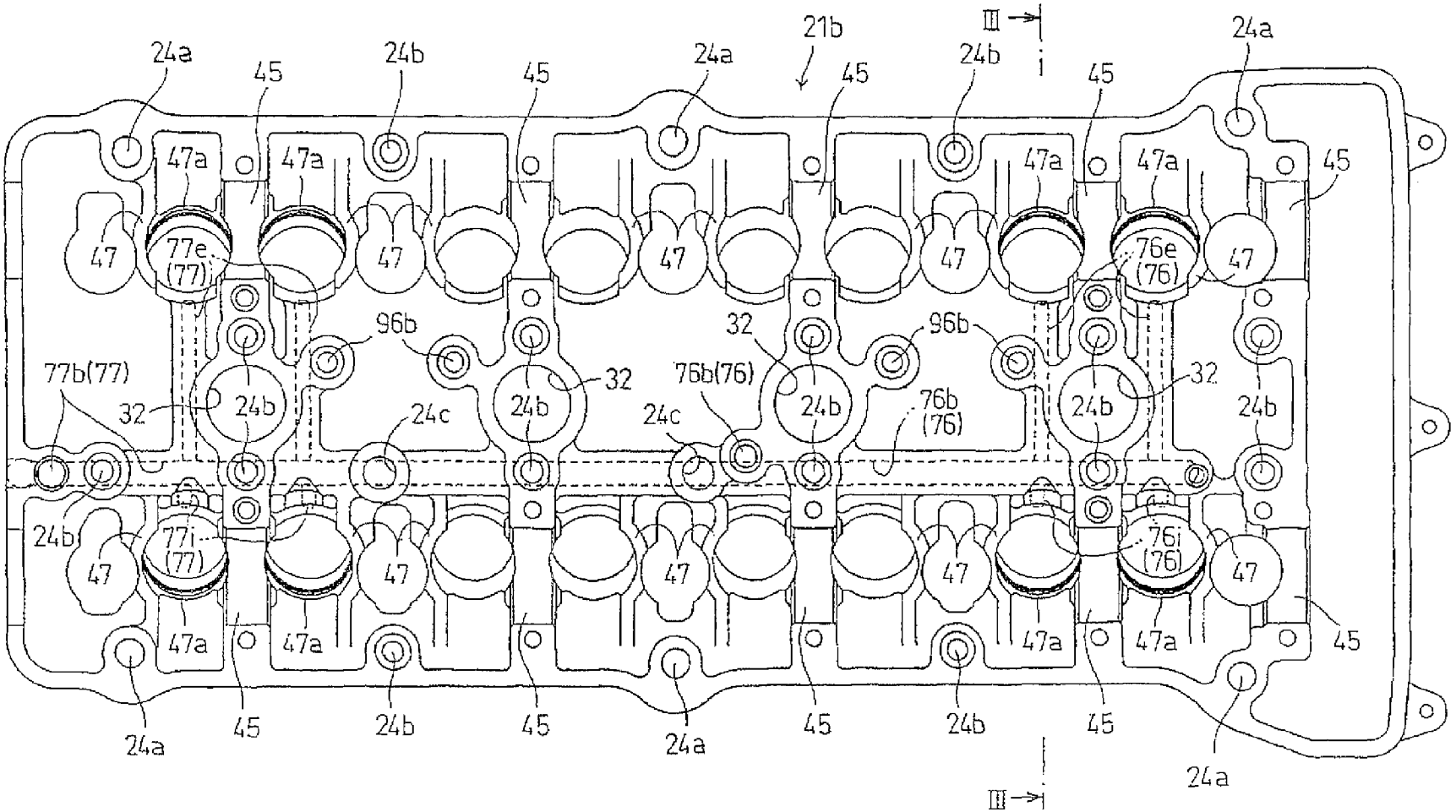
FIG. 4 is a single view of an upper cylinder head from arrow IV in FIG. 2 (that is, as viewed in a particular direction)

Referring also to FIG. 4, the cylinder head 21 is a divisible cylinder head that is obtained by combining a lower cylinder head 21*a* and an upper cylinder head 21*b* with bolts inserted into insertion holes 24*a*, 24*b*, 24*c*. The lower cylinder head 21*a* is a first cylinder head, which is coupled to the cylinder block 20. The upper cylinder head 21*b* is a second cylinder head, which is coupled to the cylinder head cover 22. The cylinder head cover 22 is coupled to the upper cylinder head 21*b* with a bolt 25 (see FIG. 5) that is screwed into the head of the bolt inserted into the insertion hole 24*a*. The bolt inserted into the insertion hole 24*c* doubles as a plug for blocking control oil paths 76, 77, which will be described later.

Referring to FIGS. 2 to 4, the lower cylinder head 21*a* includes a combustion chamber 27; which, in each cylinder C1-C4, faces the piston 26 in the direction of the cylinder axis Ly (hereinafter referred to as the cylinder axis direction); an intake port 28, which has a pair of inlets in the combustion chamber 27; an exhaust port 29, which has a pair of outlets in the combustion chamber 27 and a spark plug 30, which is substantially centered with respect to the combustion chamber 27. In addition, intake valves 35, which form a pair of engine valves for opening and closing the pair of inlets, and exhaust valves 36, which form a pair of engine valves for opening and closing the pair of outlets, are swingably mounted on the lower cylinder head 21*a*.

An ignition coil 31 and the spark plug 30, which is integral with the ignition coil 31, are inserted into a receiver hole 32 that extends to the lower cylinder head 21*a*, upper cylinder head 21*b*, and cylinder head cover 22.

The intake valves 35 and exhaust valves 36, which are pressed in the valve closing direction by the elastic force of a valve spring 37, are opened and closed in synchronism with the rotation of the crankshaft 39 by a valve gear, which is housed in a valve gear chamber 40 that is formed by the cylinder head 21 and cylinder head over 22.

The upper cylinder head 21*b* includes a cylindrical support section 47, which swingably supports after-mentioned valve lifters 43, 44 that are positioned relative to the intake valves 35 and exhaust valves 36 and a lower cam holder 45, which rotatably supports camshafts 41, 42. Thus, the upper cylinder head 21*b* doubles as a lifter holder for holding the valve lifters 43, 44.

Referring also to FIG. 1, the internal combustion engine E includes an intake device Di and an exhaust device De. The intake device Di forms an intake path Dp (schematically shown in FIG. 2) in which intake air flows. The exhaust device De forms an exhaust path in which exhaust gas flows.

The intake device Di includes an air cleaner 50, which takes in the outside air as the intake air and a throttle valve device 51, which has a throttle valve for controlling the flow rate of intake air that is cleaned as it passes through the air cleaner 50. The air cleaner 50 is positioned in a space S1 that is formed by concaving upwardly the bottom wall of the fuel tank 13 positioned above the power unit P. The throttle valve device 51 is connected to the intake side lateral wall of the lower cylinder head 21*a* in which the inlets for the intake port 28 are open.

The exhaust device De includes an exhaust pipe 52, which is connected to the exhaust side lateral wall of the lower cylinder head 21*a* in which the outlets for the exhaust port 29 are open and a pair of right and left exhaust mufflers 53, which are connected downstream of the exhaust pipe 52.

Intake air whose flow rate is regulated by the throttle valve is mixed with fuel supplied from a fuel injection valve 54 to form an air-fuel mixture. When an intake valve 35 opens, the air-fuel mixture is taken into the combustion chamber 27 through the intake port 28. The air-fuel mixture is then ignited by the spark plug 30 and burned within the combustion chamber 27. Next, the piston 26 is driven by the resulting combustion gas to rotate the crankshaft 39. When an exhaust valve 36 opens, the combustion gas is expelled to the exhaust port 29 as an exhaust gas. The exhaust gas is then discharged out of the internal combustion engine E through the exhaust pipe 52 and exhaust muffler 53.

Referring to FIGS. 2 and 3, the DOHC valve gear provided in the internal combustion engine E includes an intake camshaft 41 and an exhaust camshaft 42, which constitute a pair of camshafts parallel to each other; an intake cam 41*a*, which is a valve cam that is integral with the intake camshaft 41 and used to open/close each intake valve 35; an exhaust cam 42*a*, which is a valve cam that is integral with the exhaust camshaft 42 and used to open/close each exhaust valve 36. A valve lifter 43 is provided, which is a cam follower that the intake cam 41*a* slidably contacts and can transmit the valve opening driving force of the intake cam 41*a* to the intake valve 35; a valve lifter 44, which is a cam follower that the exhaust cam 42*a* slidably contacts and can transmit the valve opening driving force of the exhaust cam 42*a* to the exhaust valve 36; and a valve stop mechanism 60, which is a valve characteristic change mechanism for changing the valve characteristics (lift amount and open/close timing) of a particular intake valve 35i and a particular exhaust valve 36*e* in accordance with the operating status of the internal combustion engine E and motorcycle 1. The valve stop mechanism 60 stops the open/close operation of some intake valves 35i and some exhaust valves 36*e* in a particular operating state.

The cam shafts 41, 42, which are supported rotatably relative to the upper cylinder head 21*b*, are rotatably supported by a cam holder, which includes the lower cam holder 45 and an integral type upper cam holder 46 that is fastened to each lower cam holder 45 (see FIG. 4) with a bolt 48, and rotated in conjunction with the crankshaft 39 at half the rotation speed of the crankshaft 39 via a valve gear transmission mechanism 49 having a chain 49*c*.

The valve stop mechanism 60, which is of a hydraulic type, is positioned between the valve lifter 43 and intake valve 35*i* and between the valve lifter 44 and exhaust valve 36*e*, which belong to the cylinders C1, C4 of the internal combustion engine E having four cylinders, and used to switch between the transmission and non-transmission of the valve opening driving forces of the intake cam 41*a* and exhaust cam 42*a* for the intake valve 35*i* and exhaust valve 36*e*. In the aforementioned particular operating state, each valve stop mechanism 60 becomes operative as shown in FIGS. 2 and 3, stops the open/close operation of the intake valve 35*i* and exhaust valve 36*e* irrespective of the reciprocating motion of the valve lifters 43, 44, and keeps the intake valve 35*i* and exhaust valve 36*e* closed. In an operating state other than the aforementioned particular operating state (hereinafter referred to as the non-particular operating state), each valve stop mechanism 60 becomes inoperative and permits the intake valve 35*i* and exhaust valve 36*e* to open and close in accordance with the reciprocating motion of the valve lifters 43, 44, which are respectively driven by the intake cam 41*a* and exhaust cam 42*a*.

The valve stop mechanism 60 is provided for the intake valves 35*i* and exhaust valves 36*e*, that is, all the intake valves 35 and exhaust valves 36 that belong to the first and fourth cylinders C1, C4. However, the valve stop mechanism is not provided for the intake valves 35 and exhaust valves 36 (not shown) that belong to the second and third cylinders C2, C3.

All the valve stop mechanisms 60 have the same structure. Therefore, the valve stop mechanism 60 positioned between the valve lifter 43 and intake valve 35*i* will now be described with reference mainly to FIG. 3(*b*).

The valve stop mechanism 60 includes a cylindrical holder 61, which slidably engages with the inside of the valve lifter 43; a slide pin 62, which reciprocatingly engages with the holder 61; a return spring 63, which presses the slide pin 62 that reciprocates under the hydraulic pressure of a hydraulic fluid; a stopper pin 64, which prevents the slide pin 62 from rotating around a central axis; and a pressure spring 65, which presses the holder 61 against the valve lifter 43 and presses the valve lifter 43 against the intake cam 41*a*.

The holder 61 includes a circular oil path 61*a* that runs along the entire outer circumferential surface, a bottomed receiver hole 61*b* with which the slide pin 62 slidably engages, and a through hole 61*c* that a valve stem 35*a* of the intake valve 35*i* can be inserted into and is open to the receiver hole 61*b*. A hydraulic chamber 66, which communicates with the circular oil path 61*a*, is positioned between the slide pin 62 and valve lifter 43. A circular oil path 47*a* is formed along the entire inner circumferential surface of the support section 47 with which the valve lifter 43 engages. This oil path 47*a* constantly communicates with the circular oil path 61*a* through an oil hole 67 in the valve lifter 43.

The slide pin 62 is provided with a through hole 62*a* through which the valve stem 35*a* can pass. The through hole 62*a* is open to a flat abutting surface 62*b* that is formed on the outer circumferential surface of the slide pin 62. When the hydraulic pressure in the hydraulic chamber 66 is low, the elastic force of the return spring 63 places the slide pin 62 in a valve stop position shown in FIGS. 2 and 3 at which the valve stem 35*a* can be inserted into the through hole 62*a*. When, on the other hand, the hydraulic pressure in the hydraulic chamber 66 is high, the driving force exerted by the hydraulic pressure moves the slide pin 62 against the elastic force of the return spring 63 and places it in a valve operation position at which the valve stem 35*a* abuts on the abutting surface 62*b*.

As described above, when the slide pin 62 is in the valve stop position, the intake valve 35*i* and exhaust valve 36*e* are stopped in their closed position because the valve opening driving forces of the intake cam 41*a* and exhaust cam 42*a* are not transmitted to the intake valve 35*i* and exhaust valve 36*e*. When, on the other hand, the slide pin 62 is in the valve operation position, the intake valve 35*i* and exhaust valve 36*e* open or close in accordance with the rotations of the intake cam 41*a* and exhaust cam 42*a* because the valve opening driving forces of the intake cam 41*a* and exhaust cam 42*a* are transmitted to the intake valve 35*i* and exhaust valve 36*e* through the valve lifters 43, 44, holder 61, and slide pin 62.

Referring to FIGS. 2 to 5, a hydraulic control system for supplying a hydraulic fluid to each valve stop mechanism 60 uses the lubricating oil discharged from an oil pump 70 as the hydraulic fluid while the oil pump 70, which constitutes a lubrication system for the internal combustion engine E, is driven by the motive power of the crankshaft 39.

The hydraulic control system includes one or a plurality of control valve devices for controlling the hydraulic pressure of the hydraulic fluid supplied to each valve stop mechanism 60, that is, first and second control valve devices A1, A2 in the present embodiment; a supply oil path 75 for directing the hydraulic fluid discharged from the oil pump 70, which serves as a hydraulic source, to the control valve devices A1, A2 and a plurality of independent control oil paths for directing the hydraulic fluid under a hydraulic pressure controlled by the control valve devices A1, A2 to the valve stop mechanism 60, that is, two control oil paths 76, 77 in the present embodiment.

The control valve devices A1, A2, which serve as operation control units for controlling the operation of the valve stop mechanism 60, are fastened with bolts 71*c* to first and second mounting seats 22*c*, 22*d*, which are integral with an outer surface 22*b*, that is, the surface of a top wall 22*a* of the cylinder head cover 22. The mounting seats 22*c*, 22*d* protrude in a particular direction and are placed on the outer surface 22*b*.

The aforementioned particular direction is a one-way cylinder axis direction. It is a cylinder axis direction in which the cylinder head 21 and cylinder head cover 22 are oriented relative to the cylinders C1-C4.

The control valve devices A1, A2 are controlled by a control device 79 in accordance with the operating status of the internal combustion engine E and vehicle to control the hydraulic pressure of the hydraulic fluid flowing in the control oil paths 76, 77 for the purpose of raising or lowering the hydraulic pressure in the hydraulic chamber 66 of each valve stop mechanism 60.

Figure 5:
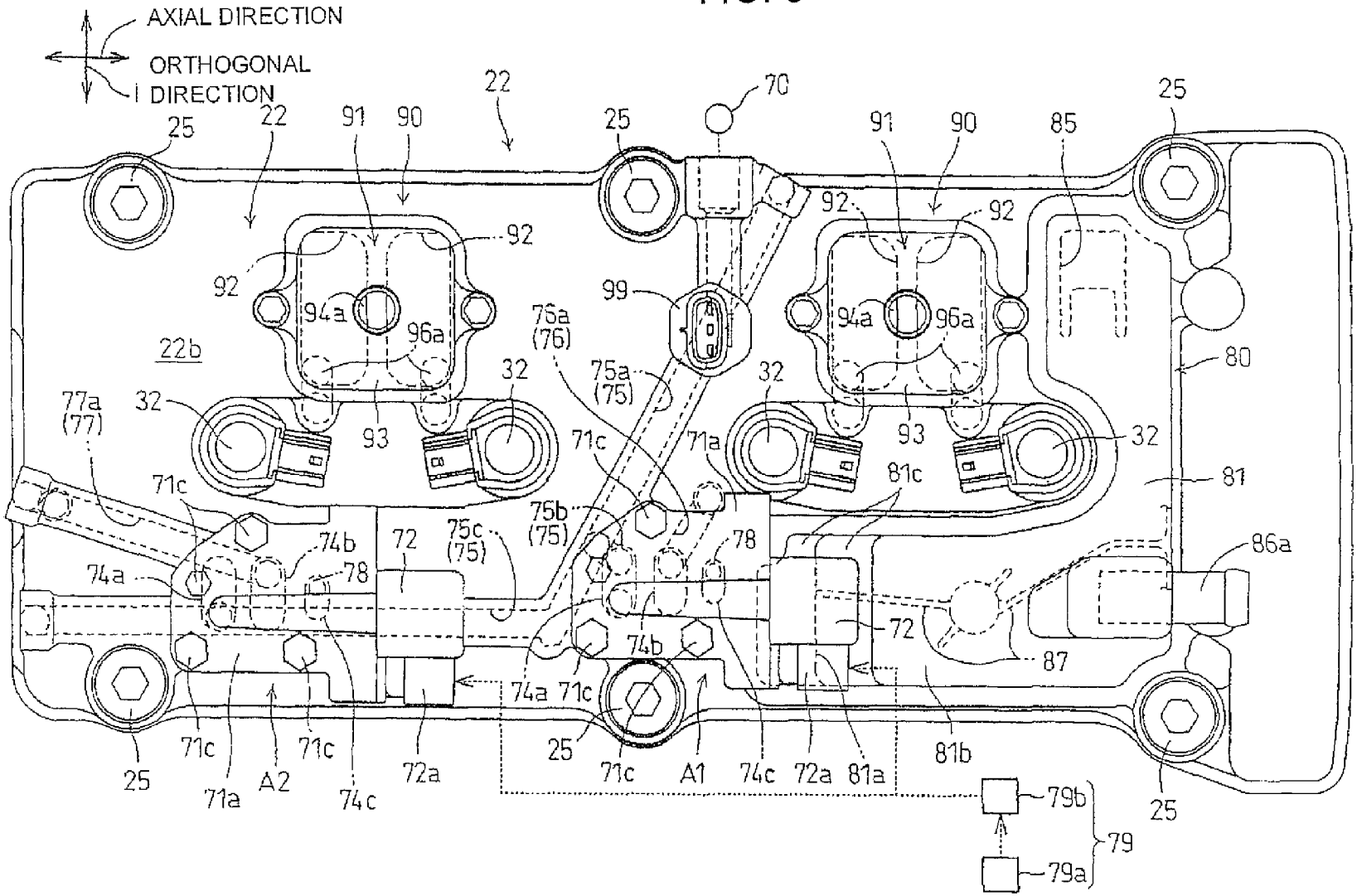
FIG. 5 is a view of the cylinder head cover from arrow V in FIG. 2 (that is, as viewed in a particular direction).

Referring to FIGS. 2 and 5, the control valve devices A1, A2, which have the same structure, include a spool valve 71 and a pilot valve 72. The spool valve 71 has a valve body 71*a* and a spool 71*b*, which is a valve element housed in the valve body 71*a*. The pilot valve 72 controls the operation of the spool valve 71. The valve body 71*a* has an inlet port 74*a*, which communicates with the supply oil path 75; an outlet port 74*b*, which communicates with the control oil paths 76, 77 and a drain port 74*c*, which communicates with a drain oil path 78 that is open to the valve gear chamber 40.

The pilot valve 72, which is made of a solenoid valve, controls the pilot hydraulic pressure applied to the spool 71*b* by opening or closing a pilot oil path 73*a*, which communicates with a pilot hydraulic chamber 73*b* formed between the valve body 71*a* and spool 71*b*, in accordance with a drive signal from the control device 79, which is transmitted through a connector section 72*a* of the pilot valve 72.

When the pilot valve 72 closes the pilot oil path 73*a*, which communicates with the inlet port 74*a*, a low hydraulic pressure prevails in the pilot hydraulic chamber 73*b*, which constantly communicates with the drain port 74*c* through an orifice 73*c* provided for the spool 71*b*. Therefore, the spool 71*b* is pressed by the elastic force of the return spring 71*d* and occupies a first position shown in FIG. 2. In the first position, the spool valve 71 cuts off the communication between the inlet port 74*a* and outlet port 74*b*, and causes the outlet port 74*b* to communicate with the drain port 74*c* so that a low hydraulic pressure prevails in the control oil paths 76, 77 and hydraulic chamber 66.

When, on the other hand, the pilot valve 72 opens the pilot oil path 73*a*, a high hydraulic pressure prevails because the hydraulic fluid in the supply oil path 75 is directed to the pilot hydraulic chamber 73*b*. Therefore, the spool 71*b* moves against the elastic force of the return spring 71*d* (moves leftward in FIG. 2) and occupies a second position. In the second position, the spool valve 71 causes the inlet port 74*a* to communicate with the outlet port 74*b*, and cuts off the communication between the outlet port 74*b* and drain port 74*c* so that a high hydraulic pressure prevails in the control oil paths 76, 77 and hydraulic chamber 66.

The control device 79 includes operating status detection means 79*a*, which detects the operating status of the internal combustion engine E and vehicle and an electronic control unit 79*b*, which inputs a signal from the operating status detection means 79*a* and outputs a drive signal to the pilot valve 72. The operating status detection means 79*a* includes, for instance, load detection means, which detects the engine load on the internal combustion engine E; rotation speed detection means, which detects the engine rotation speed and vehicle speed detection means, which detects the vehicle speed.

The supply oil path 75 includes a main oil path 75*a* to which the hydraulic fluid from the oil pump 70 is directed, and first and second distribution oil paths 75*b*, 75*c*, which are branched off from the main oil path 75*a* to direct the hydraulic fluid under a high hydraulic pressure to the inlet port 74*a* for the control valve devices A1, A2. The main oil path 75*a* and distribution oil paths 75*b*, 75*c* are provided on the cylinder head cover 22. The distribution oil paths 75*b*, 75*c* are respectively open to the inlet port 74*a* at the first and second mounting seats 22*c*, 22*d*.

The first control oil path 76 includes an oil path 76*a*, which is provided on the cylinder head cover 22 and open to the outlet port 74*b* for the control valve device A1 at the upstream end and an upstream oil path 76*b* and downstream oil paths 76*i*, 76*e*, which are provided on the upper cylinder head 21*b*. The upstream oil path 76*b* is open to the oil path 76*a* at the upstream end. The downstream oil paths 76*i*, 76*e* for the intake valve 35*i* and exhaust valve 36*e* are open to the upstream oil path 76*b* at the upstream end and open, at the downstream end, to the circular oil path 47*a* for the support section 47 that belongs to the cylinder C1.

Similarly, the second control oil path 77 includes an oil path 77*a*, which is provided on the cylinder head cover 22 and open to the outlet port 74*b* for the control valve device A2 at the upstream end; and an upstream oil path 77*b* and downstream oil paths 77*i*, 77*e*, which are provided on the upper cylinder head 21*b*. The upstream oil path 77*b* is open to the oil path 77*a* at the upstream end. The downstream oil paths 77*i*, 77*e* for the intake valve 35*i* and exhaust valve 36*e* are open to the upstream oil path 77*b* at the upstream end and open, at the downstream end, to the circular oil path 47*a* for the support section 47 that belongs to the cylinder C4.

Consequently, each valve stop mechanism 60 is controlled by the control device 79 via the hydraulic control system.

The internal combustion engine E can operate in three different operation patterns depending on whether each valve stop mechanism 60 is operative or inoperative.

In an operation pattern for a low-load operation region or other fuel efficiency optimization operation region of the internal combustion engine E, the operation is in the aforementioned particular operating state in which at least either of the cylinders C1 and C4 is stopped. More specifically, in a first operation region within the fuel efficiency optimization operation region, that is, in a region where the engine load is relatively low, the spool valve 71 of each control valve device A1, A2 occupies the first position so that a low hydraulic pressure prevails in the control oil paths 76, 77 and hydraulic chamber 66. The valve stop mechanism 60 for the intake valve 35*i* and exhaust valve 36*e* that belong to the cylinders C1 and C4 then becomes operative to stop the intake valve 35*i* and exhaust valve 36*e* for cylinders C1 and C4, thereby bringing the cylinders C1 and C4 to a stop. Consequently, the cylinders C1 and C4, which can stop, are both stopped.

On the other hand, in a second operation region within the fuel efficiency optimization operation region, that is, in a fuel efficiency optimization operation region where the engine load is higher than in the first operation region, the spool valve 71 of the first control valve device A1 occupies the first position so that a low hydraulic pressure prevails in the control oil path 76 and hydraulic chamber 66. The valve stop mechanism 60 for the intake valve 35*i* and exhaust valve 36*e* for the cylinder C1 then becomes operative to stop the intake valve 35*i* and exhaust valve 36*e* for the cylinder C1, thereby bringing the cylinder C1 to a stop. In this instance, the spool valve 71 of the second control valve device A2 occupies the second position so that a high hydraulic pressure prevails in the control oil path 77 and hydraulic chamber 66. The valve stop mechanism 60 for the intake valve 35*i* and exhaust valve 36*e* for the cylinder C4 then becomes inoperative to activate the intake valve 35*i* and exhaust valve 36*e* for the cylinder C4, thereby operating the cylinder C4. In the second operation region, therefore, only the cylinder C1 comes to a stop although the cylinders C1 and C4 can both stop.

In an operation pattern for an output optimization operation region of the internal combustion engine E such as a high-load operation region or startup/acceleration operation region, the operation is in the aforementioned non-particular operating state in which the spool 71*b* for the control valve devices A1, A2 is in the second position. Therefore, the hydraulic fluid in the supply oil path 75 is directed to the control oil paths 76, 77 and hydraulic chamber 66 to make each valve stop mechanism 60 inoperative. Consequently, the intake valve 35*i* and exhaust valve 36*e* for the cylinders C1 and C4 become active to operate all the cylinders C1-C4.

Thus, the second and third cylinders C2, C3 are constantly operating cylinders, which operate at all times. On the other hand, the first and fourth cylinders C1, C4 are deactivatable cylinders, which stop in the particular operating state and operate in the non-particular operating state. Therefore, the valve stop mechanisms 60 for the first and fourth cylinders C1, C4 of the internal combustion engine E having four cylinders C1-C4 constitute a cylinder stop mechanism that selectively activates or deactivates the first and fourth cylinders C1, C4. The control device 79 serves as a number-of-cylinders control device that controls the operations of the valve stop mechanisms 60 to change the number of operating cylinders as needed in accordance with the operating status detected by the operating status detection means 79*a*.

Referring to FIGS. 2, 3, and 5, the top wall 22*a* of the cylinder head cover 22, which is substantially shaped like a quadrangle when viewed in a particular direction, is provided with the receiver hole 32 in which the spark plug 30 and ignition coil 31 are placed, a breather chamber 83 for a breather 80, a valve device 91 for a secondary air supply device 90, the control valve devices A1, A2, and a hydraulic pressure sensor 99 for detecting the hydraulic pressure of the hydraulic fluid in the main oil path 75*a*.

The breather 80, which causes a blow-by gas to flow backward to the intake device Di (see FIG. 1), includes an upstream breather path (not shown), which is made of holes in the cylinder block 20 and cylinder head 21 to establish communication between the crank chamber and valve gear chamber 40; the breather chamber 83 into which a blow-by gas in the crank chamber flows through the upstream breather path and valve gear chamber 40 and a downstream breather path 84, which is made of a conduit 84*a* to establish communication between the breather chamber 83 and intake path Dp.

The breather chamber 83 is formed by an outer chamber wall 81, which is integral with the top wall 22*a*, and a breather chamber wall W, which is made of a partition plate 82 that is fastened to the outer chamber wall 81 in the valve gear chamber 40 with fasteners, that is, a plurality of bolts 82*b* (one of the plurality of bolts is shown in FIGS. 2 and 3) and used as an inner chamber wall. The outer chamber wall 81 is protruded in a particular direction, mounted on the outer surface 22*b*, and placed at the same position as at least a part of the control valve devices A1, A2 in a particular direction (or in the cylinder axis direction) (see FIG. 2).

A plurality of baffle plates 87, which are integral with the outer chamber wall 81, are provided within the breather chamber 83 to form a labyrinthine path in the breather chamber 83. The baffle plates 87 facilitate oil separation. The breather chamber 83 communicates with the valve gear chamber 40 through an inflow port 85, which is made of a hole in the partition plate 82, and communicates with the downstream breather path 84 through an outflow port 86, which is formed by a pipe joint 86*a* that is mounted on the outer chamber wall 81 and connected to the conduit 84*a*. The downstream breather path 84 is used so that a blow-by gas flowing out of the breather chamber 83 after oil separation from the blow-by gas in the breather chamber 83 is directed to the intake path Dp.

The outer chamber wall 81 (thus the breather chamber 83) is mounted on the outer surface 22*b* so as to have an overlap section 81*a* (see FIGS. 2 and 5) that overlaps with a part of the first control valve device A1 in the axial direction when viewed in a particular direction (or viewed in the cylinder axis direction or from above in FIG. 2 in the present embodiment). The overlap section 81*a* corresponds to an overlap section 83*a* of the breather chamber 83 and to an overlap section 82*a* of the partition plate 82.

More specifically, in a situation where first and second directions are orthogonal to each other when viewed in a particular direction, the first direction is the rotation center line direction of the camshafts 41, 42 (or the rotation center line direction of the crankshaft 39 or the left-right direction in the present embodiment), and the second direction is orthogonal to the axial direction, the outer chamber wall 81 positioned at the right end of the cylinder head cover 22 in the axial direction has an extended section 81*b* that is extended to the left toward the control valve device A1 in the axial direction. Therefore, the breather chamber 83 also has an extended section 83*b* that is formed by the extended section 81*b*.

Here, when one of the rightward and leftward directions is one axial direction, the other rightward or leftward direction is the other axial direction.

The extended section 81*b* includes a shoulder 81*c*, which is a concaved section positioned at the leading end of the extended section 81*b* and provided with one or a plurality of steps or two steps in the present embodiment. The height of the shoulder 81*c* gradually decreases in the leftward direction. The shoulder 81*c* is formed along the outline of a stepped portion that is formed by the pilot valve 72 and valve body 71*a* of the control valve device A1 (see FIG. 2).

When viewed in a particular direction, the shoulder 81*c* has the overlap section 81*a* that overlaps with the pilot valve 72, valve body 71*a*, and connector section 72*a*, and occupies the same position in the axial direction as the pilot valve 72, valve body 71*a*, and connector section 72*a*. Therefore, the overlap section 83*a* is formed in the extended section 83*b* by the shoulder 81*c*. Since the overlap sections 81*a*, 83*a* exist, the breather chamber 83 or breather chamber wall W and control valve device A1 can be compactly positioned in the axial direction due to the existence of the overlap sections 81*a*, 83*a* as compared to a case where the extended sections 81*b*, 83*b* do not occupy the same position in the axial direction as the control valve device A1. This makes it possible to avoid the axial enlargement of the cylinder head cover 22 on which the breather chamber 83 or breather chamber wall W and control valve device A1 are mounted. In addition, the capacity of the breather chamber 83 increases because the extended sections 81*b*, 83*b* are axially extended to the same position as the control valve device A1.

The shoulder 81*c* and overlap sections 81*a*, 83*a* use a space 82 between the control valve device A1 and outer surface 22*b* in a particular direction, and are positioned in the space S2 formed in relation to the outer surface 22*b* in a direction opposite the particular direction relative to the control valve device A1. Therefore, the overlap sections 81*a*, 83*a* are covered in the particular direction by the pilot valve 72, valve body 71*a*, and connector section 72*a*.

Referring to FIG. 1, the outer chamber wall 81 (thus the breather chamber 83), the first and second control valve devices A1, A2, and the valve device 91 are vertically positioned in a space S3 that is formed directly below the air cleaner 50 and sandwiched between the air cleaner 50 and cylinder head cover 22. The extended section 81*b* (see FIG. 5) and control valve devices A1, A2 are positioned close to the air cleaner 50 and toward a particular side within the wedge-shaped space S3 so that they are vertically arranged at narrow intervals as viewed in the direction of the vehicle width.

Referring to FIGS. 3, 4, and 5, one or a plurality of secondary air supply devices 90 or two secondary air supply devices 90 in the present embodiment, which operate so that the air for purifying an exhaust gas by oxidizing HC, CO, and other unburned components in the exhaust gas is added to the exhaust gas, each include the valve device 91, which is mounted on the cylinder head cover 22 to regulate the air flow rate; an air intake path 95, which directs the intake air from the air cleaner 50 to the valve device 91 and an air supply path 96, which directs the air from the valve device 91 to the exhaust port 29.

The valve device 91 includes a reed valve 92, which opens and closes in accordance with the pressure of the exhaust gas, and a valve housing 93, which is mounted on the top wall 22*a* to form a valve chest 94 that houses the reed valve 92. The valve chest 94, which has an inflow port 94*a* into which the air from the air intake path 95 flows, houses two reed valves 92 that control the amount of air supplied to the exhaust ports 29 for neighboring cylinders C1-C4.

The air supply path 96, in which air whose flow rate is adjusted by the reed valve 92 flows, includes a path 96*a* that is positioned on the cylinder head cover 22 and open to the valve chest 94, a path 96*b* (see FIG. 4 as well) that is positioned on the upper cylinder head 21*b* and open to the path 96*a* at the upstream end, and a path 96*c* that is positioned on the lower cylinder head 21*a*, open to the path 96*b* at the upstream end, and open to the exhaust port 29 at the downstream end.

The operation and effect of the present embodiment, which is configured as described above, will now be described.

In the internal combustion engine E in which the outer chamber wall 81 of the breather chamber wall W constituting the breather chamber 83 and the control valve device A1 are protruded in a particular direction and mounted on the outer surface 22*b* of the top wall 22*a* of the cylinder head cover 22, the outer chamber wall 81 and breather chamber 83 have the overlap sections 81*a*, 83*a* that overlap with a part of the control valve device A1 when viewed in a particular direction. Therefore, the overlap sections 81*a*, 83*a* increase the capacity of the breather chamber 83. In addition, the outer chamber wall 81 and control valve device A1 are compactly arranged. This makes it possible to avoid the enlargement of the cylinder head cover 22 on which the breather chamber wall W and control valve device A1 are mounted.

The overlap sections 81*a*, 83*a* are covered in a particular direction by the control valve device A1. Therefore, the overlap sections 81*a*, 83*a* are positioned in the space S2 formed in relation to the outer surface 22*b* in a direction opposite the particular direction relative to the control valve device A1. Consequently, the overlap sections 81*a*, 83*a* can be compactly arranged in the particular direction or cylinder axis direction as compared to a case where the overlap sections 81*a*, 83*a* are positioned toward the particular direction relative to the control valve device A1.

The outer chamber wall 81 has the shoulder 81*c*, which is a concaved section that is shaped along the outline of the control valve device A1. Further, the overlap section 81*a* is the shoulder 81*c*. Thus, the overlap section 81*a* is the shoulder 81*c* that is formed along the outline of the control valve device A1. This makes it possible to enhance the utilization of the space formed around the control valve device A1. As a result, the capacity of the breather chamber 83 can be further increased while compactly arranging the outer chamber wall 81 and control valve device A1.

The cylinder block 20 of the engine main body has the cylinders C1-C4. Further, an operation control mechanism whose operation is controlled by the control valve devices A1, A2 is a cylinder stop mechanism that stops some of the cylinders C1-C4. This makes it possible to compactly arrange the outer chamber wall 81 and the control valve device A1, which controls the cylinder stop mechanism for changing the number of operating cylinders, while increasing the capacity of the breather chamber 83 for the internal combustion engine E in which the number of cylinders is controlled.

The control valve device A1 and outer chamber wall 81 are positioned within the space S3 formed between the air cleaner 50 and cylinder head cover 22 so that the outer chamber wall 81 and breather chamber 83*a* have the overlap sections 81*a*, 83*a*. This makes it possible to avoid the enlargement of the cylinder head cover 22 by compactly mounting the outer chamber wall 81 and control valve device A1 on the cylinder head cover 22. Consequently, the air cleaner 50 and the cylinder head cover 22, which includes the breather chamber 83 whose capacity is increased by the extended section 81*b*, can be positioned close to each other for a compact arrangement.

The configurations of modified embodiments, which are obtained by partially changing the embodiment described above, will now be described.

The cylinder head 21 may alternatively be constructed of one piece without joints by combining the lower cylinder head 21*a* and upper cylinder head 21*b*.

The operation control mechanism may alternatively be a mechanism other than the valve stop mechanism 60, such as a valve characteristic change mechanism for controlling the lift amount or open/close timing of the intake valve 35*i* or exhaust valve 36*e*. The operation control unit may alternatively be an electric apparatus or an actuator such an electric motor.

The particular direction may alternatively be irrelevant to the cylinder axis direction and a direction in which the outer surface is positioned relative to the inner surface of the engine main body (e.g., cylinder head cover or cylinder head).

The overlap section of the outer chamber wall 81 or breather chamber 83 may alternatively be formed by allowing the outer chamber wall 81 of the breather chamber wall W to cover a part of the control valve device A1 in a particular direction.

The internal combustion engine may alternatively be a single-cylinder internal combustion engine that includes a cylinder block having one cylinder.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

an operation control unit for controlling the operation of an operation control mechanism, which controls an engine operating state; and a breather chamber wall for forming a breather chamber into which a blow-by gas flows;

the operation control unit and the breather chamber wall projecting in a particular direction are positioned on the outer surface of an engine main body;

wherein the breather chamber wall includes an overlap section that overlaps with a part of the operation control unit when viewed in the particular direction, wherein the engine main body has a plurality of cylinders and the operation control mechanism is a cylinder stop mechanism for stopping some of the plurality of cylinders.

2. The internal combustion engine according to claim 1, wherein the overlap section is covered in the particular direction by the operation control unit.

3. The internal combustion engine according to claim 1, wherein the breather chamber wall has a concaved section that is shaped along an outline of the operation control unit and the overlap section is the concaved section.

4. The internal combustion engine according to claim 2, wherein the breather chamber wall has a concaved section that is shaped along an outline of the operation control unit and the overlap section is the concaved section.

5. The internal combustion engine according to claim 2, wherein the engine main body has four cylinders and the operation control mechanism includes two operation control units each of which is a cylinder stop mechanism for stopping one of the four cylinders.

6. The internal combustion engine according to claim 3, wherein the outer surface on which the operation control unit and the breather chamber are positioned is an outer surface of a top wall of a cylinder head cover.

7. The internal combustion engine according to claim 4, wherein the particular direction is parallel to an axis of the cylinders of the engine.

8. The internal combustion engine according to claim 1, and further comprising:

an air cleaner;

wherein the outer surface is an outer surface of a top wall of a cylinder head cover that constitutes the engine main body; and the operation control unit and the breather chamber wall are positioned in a space formed between the air cleaner and the cylinder head cover.

9. The internal combustion engine according to claim 2, and further comprising:

an air cleaner;

wherein the outer surface is an outer surface of a top wall of a cylinder head cover that constitutes the engine main body; and the operation control unit and the breather chamber wall are positioned in a space formed between the air cleaner and the cylinder head cover.

10. The internal combustion engine according to claim 3, and further comprising:

an air cleaner;

wherein the outer surface is an outer surface of a top wall of a cylinder head cover that constitutes the engine main body; and the operation control unit and the breather chamber wall are positioned in a space formed between the air cleaner and the cylinder head cover.

11. The internal combustion engine according to claim 1, wherein the operation control unit includes a reciprocating slide pin extending horizontally with respect to a valve axis of the engine.

12. An internal combustion engine comprising:

an operation control unit for controlling the operation of an operation control mechanism, which controls an engine operating state; and a breather chamber wall for forming a breather chamber into which a blow-by gas flows;

the operation control unit and the breather chamber wall projecting in a particular direction and positioned on the outer surface of an engine main body;

wherein the breather chamber wall includes an overlap section that overlaps with a part of the operation control unit when viewed in the particular direction, and further comprising:

an air cleaner;

wherein the outer surface is an outer surface of a top wall of a cylinder head cover that constitutes the engine main body; and the operation control unit and the breather chamber wall are positioned in a space formed between the air cleaner and the cylinder head cover wherein the engine main body has a plurality if cylinders and the operation control mechanism is a cylinder stop mechanism for stopping some of the plurality of cylinders.

13. An operation control unit for controlling the operation of an operation control mechanism for controlling an engine operating state comprising:

a breather chamber wall for forming a breather chamber into which a blow-by gas flows;

said operation control unit and the breather chamber wall projecting in a predetermined direction are positioned on the outer surface of an engine main body; and an overlap section formed in the breather chamber wall for overlapping with a part of the operation control unit when viewed in the predetermined direction, wherein the engine main body has a plurality of cylinders and the operation control mechanism is a cylinder stop mechanism for stopping some of the plurality of cylinders.

14. The operation control unit according to claim 13, wherein the overlap section is covered in the predetermined direction by the operation control unit.

15. The operation control unit according to claim 13, wherein the breather chamber wall has a concaved section that is shaped along an outline of the operation control unit and the overlap section is the concaved section.

16. The operation control unit according to claim 14, wherein the engine main body has four cylinders and the operation control mechanism includes two operation control units each of which is a cylinder stop mechanism for stopping one of the four cylinders.

17. The operation control unit according to claim 15 wherein the outer surface on which the operation control unit and the breather chamber are positioned is an outer surface of a top wall of a cylinder head cover.

18. The operation control unit according to claim 13, and further comprising:

an air cleaner;

wherein the outer surface is an outer surface of a top wall of a cylinder head cover that constitutes the engine main body; and the operation control unit and the breather chamber wall are positioned in a space formed between the air cleaner and the cylinder head cover.

* * * * *